US005813485A

United States Patent [19]

Portwood

[11] Patent Number: 5,813,485

[45] Date of Patent: Sep. 29, 1998

[54] CUTTER ELEMENT ADAPTED TO WITHSTAND TENSILE STRESS

[75] Inventor: Gary R. Portwood, Kingwood, Tex.

[73] Assignee: Smith International, Inc., Houston, Tex.

[21] Appl. No.: 668,109

[22] Filed: Jun. 21, 1996

[51] Int. Cl.[6] ..... E21B 10/08

[52] U.S. Cl. ..... 175/430; 175/431

[58] Field of Search ..... 175/374, 426, 175/425, 431, 430

[56] References Cited

U.S. PATENT DOCUMENTS

| | | | |
|---|---|---|---|
| 3,401,759 | 9/1968 | White | 175/341 |
| 4,058,177 | 11/1977 | Langford, Jr. et al. | 175/374 |
| 4,108,260 | 8/1978 | Bozarth | 175/374 |
| 4,334,586 | 6/1982 | Schumacher | 175/374 |
| 4,604,106 | 8/1986 | Hall et al. | 51/293 |
| 4,629,373 | 12/1986 | Hall | 407/118 |
| 4,694,918 | 9/1987 | Hall | 175/329 |
| 4,811,801 | 3/1989 | Salesky et al. | 175/329 |
| 4,832,139 | 5/1989 | Minikus et al. | 175/374 |
| 5,145,016 | 9/1992 | Estes | 175/331 |
| 5,172,777 | 12/1992 | Siracki et al. | 175/374 |
| 5,172,779 | 12/1992 | Siracki et al. | 175/420 |
| 5,197,555 | 3/1993 | Estes | 175/431 |
| 5,201,376 | 4/1993 | Williams | 175/374 |
| 5,287,936 | 2/1994 | Grimes et al. | 175/331 |
| 5,322,138 | 6/1994 | Siracki | 175/374 |
| 5,323,865 | 6/1994 | Isbell et al. | 175/378 |
| 5,341,890 | 8/1994 | Cawthorne et al. | 175/374 |
| 5,346,026 | 9/1994 | Pessier et al. | 175/331 |
| 5,351,768 | 10/1994 | Scott et al. | 175/374 |
| 5,351,770 | 10/1994 | Cawthorne et al. | 175/374 |
| 5,353,885 | 10/1994 | Hooper et al. | 175/378 |
| 5,407,022 | 4/1995 | Scott et al. | 175/331 |
| 5,415,244 | 5/1995 | Portwood | 175/374 |
| 5,421,423 | 6/1995 | Huffstutler | 175/374 |
| 5,421,424 | 6/1995 | Portwood et al. | 175/374 |
| 5,479,997 | 1/1996 | Scott et al. | 175/374 |
| 5,592,995 | 1/1997 | Scott et al. | 175/374 |

*Primary Examiner*—Frank Tsay
*Attorney, Agent, or Firm*—Conley,Rose & Tayon, P.C.

[57] ABSTRACT

A cutter element having a substantially flat wear face and leading and trailing sections, wherein the leading section is sharper than the trailing section. Sharpness is defined as either a smaller inside angle at the intersection of a pair of planes or as a smaller radius of curvature. The insert of the present invention experiences reduced stress on its trailing portion and therefore is less subject to extreme wear and failure. The present invention can be applied with particular advantage to heel row cutters, but can also be applied to cutters in other rows that primarily ream the borehole wall. The present cutter element can be constructed so as to have either a positive or negative rake angle at its leading section, or to have any of a variety of shapes, depending on the characteristics of the formation in which it is to be used.

69 Claims, 10 Drawing Sheets

CUTTER ELEMENT ADAPTED TO WITHSTAND TENSILE STRESS

FIELD OF THE INVENTION

The invention relates generally to earth-boring bits used to drill a borehole for the ultimate recovery of oil, gas or minerals. More particularly, the invention relates to rolling cone rock bits having cutting inserts and to a more durable structure for such inserts. Still more particularly, the invention relates to an insert having a leading, borehole-engaging section that is sharper than its trailing section.

BACKGROUND OF THE INVENTION

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cutters that perform their cutting function due to the rolling movement of the cutters acting against the formation material. The cutters roll and slide upon the bottom of the borehole as the bit is rotated, the cutters thereby engaging and disintegrating the formation material in its path. The rotatable cutters may be described as generally conical in shape and are therefore sometimes referred to as rolling cones. Such bits typically include a bit body with a plurality of journal segment legs. The cutters are mounted on bearing pin shafts which extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit. The drilling fluid carries the chips and cuttings as it flows up and out of the borehole.

The earth disintegrating action of the rolling cone cutters is enhanced by providing the cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are known as "steel tooth bits."In each case, the cutter elements on the rotating cutters functionally breakup the formation to form new borehole by a combination of gouging and scraping or chipping and crushing.

The cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its rate of penetration ("ROP"), as well as its durability or ability to maintain an acceptable ROP. As is apparent, dull, broken or worn cutter elements cause a decrease in ROP. The form and positioning of the cutter elements (both steel teeth and TCI inserts) upon the cutters greatly impact bit durability and ROP and thus are critical to the success of a particular bit design.

Bit durability is, in part, measured by a bit's ability to "hold gage," meaning its ability to maintain a full gage borehole diameter over the entire length of the borehole. Gage holding ability is particularly vital in directional drilling applications which have become increasingly important. If gage is not maintained at a relatively constant dimension, it becomes more difficult, and thus more costly, to insert drilling apparatus into the borehole than if the borehole had a constant diameter. For example, when a new, unworn bit is inserted into an undergage borehole, the new bit will be required to ream the undergage hole as it progresses toward the bottom of the borehole. Thus, by the time it reaches the bottom, the bit may have experienced a substantial amount of wear that it would not have experienced had the prior bit been able to maintain full gage. This unnecessary wear will shorten the bit life of the newly-inserted bit, thus prematurely requiring the time consuming and expensive process of removing the drill string, replacing the worn bit, and reinstalling another new bit downhole.

To assist in maintaining the gage of a borehole, conventional rolling cone bits typically employ a heel row of hard metal inserts on the heel surface of the rolling cone cutters. The heel surface is a generally frustoconical surface and is configured and positioned so as to generally align with and ream the sidewall of the borehole as the bit rotates. The inserts in the heel surface contact the borehole wall with a sliding motion and thus generally may be described as scraping or reaming the borehole sidewall. The heel inserts function primarily to maintain a constant gage and secondarily to prevent the erosion and abrasion of the heel surface of the rolling cone. Excessive wear of the heel inserts leads to an undergage borehole, decreased ROP and increased loading on the other cutter elements on the bit, and may accelerate wear of the cutter bearing and ultimately lead to bit failure.

In addition to the heel row inserts, conventional bits typically include a gage row of cutter elements mounted adjacent to the heel surface but orientated and sized in such a manner so as to cut the corner of the borehole. Conventional bits also include a number of additional rows of cutter elements that are located on the cones in rows disposed radially inward from the gage row. These cutter elements are sized and configured for cutting the bottom of the borehole and are typically described as inner row cutter elements.

Each cutter element on the bit has what is commonly termed a leading face or edge and a trailing face or edge. The leading face or edge is defined as that portion of the cutting surface of the cutter element that first contacts the formation as the bit rotates. The trailing face or edge is the portion of the cutter opposite the leading face or edge. Referring briefly to FIG. 1A, these concepts are best shown in the context of a projection of the cutting elements on a single rolling cone. As shown in FIG. 1A, the leading edge is defined for purposes of this invention as that portion of the cutter element that is on the side of the element that is opposite the direction of rotation of the cone. The trailing edge is opposite the leading edge. FIG. 1A shows hypothetical leading and trailing edges and shows an imaginary line dividing the leading and trailing edges as being approximately parallel to the cone axis. It will be understood, however, that this imaginary division can occur as much as 90 degrees counterclockwise (as drawn) of the bit axis, depending on the precise configuration of the cutter element, cone and bit.

The terms "leading" and "trailing" will be used hereinafter to refer to these portions respectively, regardless of whether the section so referred to is planar, contoured or includes an edge. Because the precise portion of the cutter element meeting each definition varies not only with bit design and cutter element design, but also with movement of the rolling cone, it will be understood by those skilled in the art that the terms "leading" and "trailing" are functional and are each meant to be defined in terms of the operation of the drill bit and cutter element itself.

Particularly with respect to heel row cutter elements, it has been found that the trailing section is subject to earlier failure than the leading section. The predominant failure mode of the trailing section, and ultimately of the whole cutter, is the result of excessive friction along the trailing section and of tensile stresses that are localized in the trailing section. Unlike the leading section, the trailing section of the cutter does not engage in shearing or reaming of the borehole wall and is subjected to significantly less compressive forces. Instead, as a result of frictional contact with the borehole wall, the trailing section is subjected to tensile loading and thus to tensile stress. Inserts coated with superabrasive materials, such as PDC and PCBN, are adversely affected by the application of tensile stress, although uncoated inserts can also suffer damage on the unsupported edge. Because diamond is relatively brittle, diamond coating tends to crack and break off, leaving the insert unprotected. Diamond coated inserts are better suited to withstand wear and frictional heat compared to uncoated inserts, but are adversely affected by the application of tensile loading.

SUMMARY OF THE INVENTION

The present invention provides a novel borehole wall cutter element for an earth boring bit that avoids damage that is typically caused by tensile stresses in conventional cutter elements. The present cutter element includes a leading section that is sharper than its trailing section. By providing a trailing edge that is better supported and therefore able to better withstand tensile loading, the overall life of both the cutter element and the drill bit are improved.

The present invention further provides an earth boring bit for drilling a borehole of a predetermined gage, the bit providing increased durability, ROP and footage drilled (at full gage) as compared with similar bits of conventional technology. The bit includes a bit body and one or more rolling cone cutters rotatably mounted on the bit body. The rolling cone cutter includes a generally conical surface, an adjacent heel surface, and preferably a circumferential shoulder therebetween. Each of the heel, conical and shoulder surfaces may support a plurality of cutter elements that are adapted to cut into the formation so as to produce the desired borehole.

According to the invention, the cutter elements may be hard metal inserts having cutting portions attached to generally cylindrical base portions which are mounted in the cone cutter, or may comprise steel teeth that are milled, cast, or otherwise integrally formed from the cone material. In either case, the present cutter elements are configured and formed so as to reduce tensile stresses on the trailing section. This is accomplished by increasing the angle at which the trailing face of the cutter element interfaces with the wear face or by increasing the radius between the two faces, or a combination of both. This design enables the cutter elements to withstand longer use, so as to enhance ROP, bit durability and footage drilled at full gage.

In one embodiment of the present invention, inserts are formed having substantially frustoconical, curved leading and trailing faces, which intersect the wear face of the cutter element at a curved edge. The insert is configured in accordance with the principles of the present invention such that the inside angle at which the curved leading face intersects the wear face is less than the inside angle at which the curved trailing face intersects the wear face.

In another embodiment of the invention, the sides of the present insert may be curvilinear and the transitions between the leading and trailing faces and the wear face are rounded. In this embodiment, the leading transition is made sharper than the trailing transition by designing it such that the leading transition has a smaller radius of curvature than the radius of curvature of the trailing transition.

BRIEF DESCRIPTION OF THE DRAWINGS

For an introduction to the detailed description of the preferred embodiments of the invention, reference will now be made to the accompanying drawings, wherein.

DETAILED DESCRIPTION OF THE PREFERRED EMBODIMENTS

Figure 1:
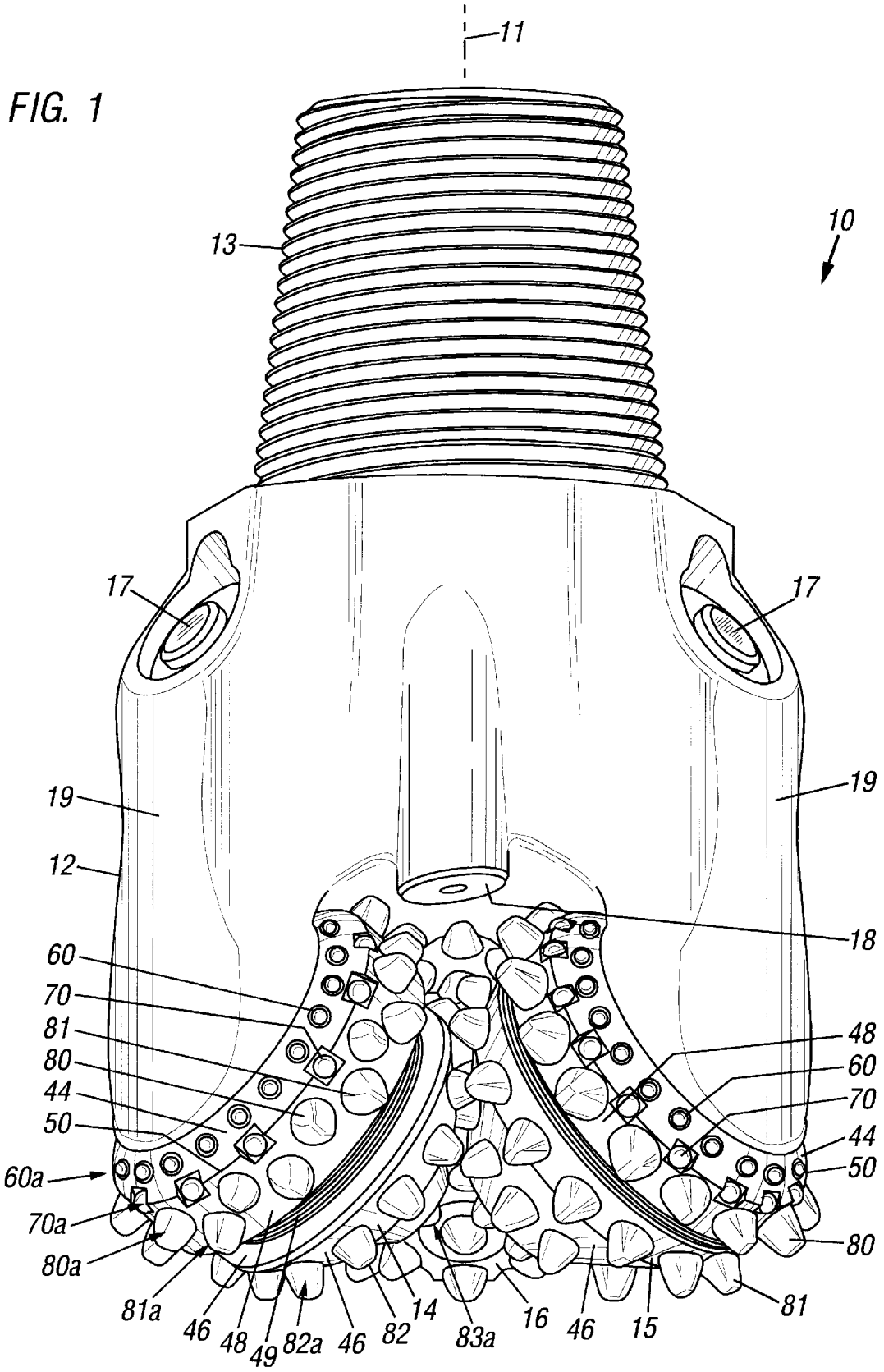
FIG. 1 is a perspective view of an earth boring bit.

Referring first to FIG. 1, an earth-boring bit 10 made in accordance with the present invention includes a central axis 11 and a bit body 12 having a threaded section 13 on its upper end for securing the bit to the drill string (not shown). Bit 10 has a predetermined gage diameter as defined by three rolling cone cutters 14, 15, 16 rotatably mounted on bearing shafts that depend from the bit body 12. Bit body 12 is composed of three sections or legs 19 (two shown in FIG. 1) that are welded together to form bit body 12. Bit 10 further includes a plurality of nozzles 18 that are provided for directing drilling fluid toward the bottom of the borehole and around cutters 14–16. Bit 10 further includes lubricant reservoirs 17 that supply lubricant to the bearings of each of the cutters.

Figure 2:
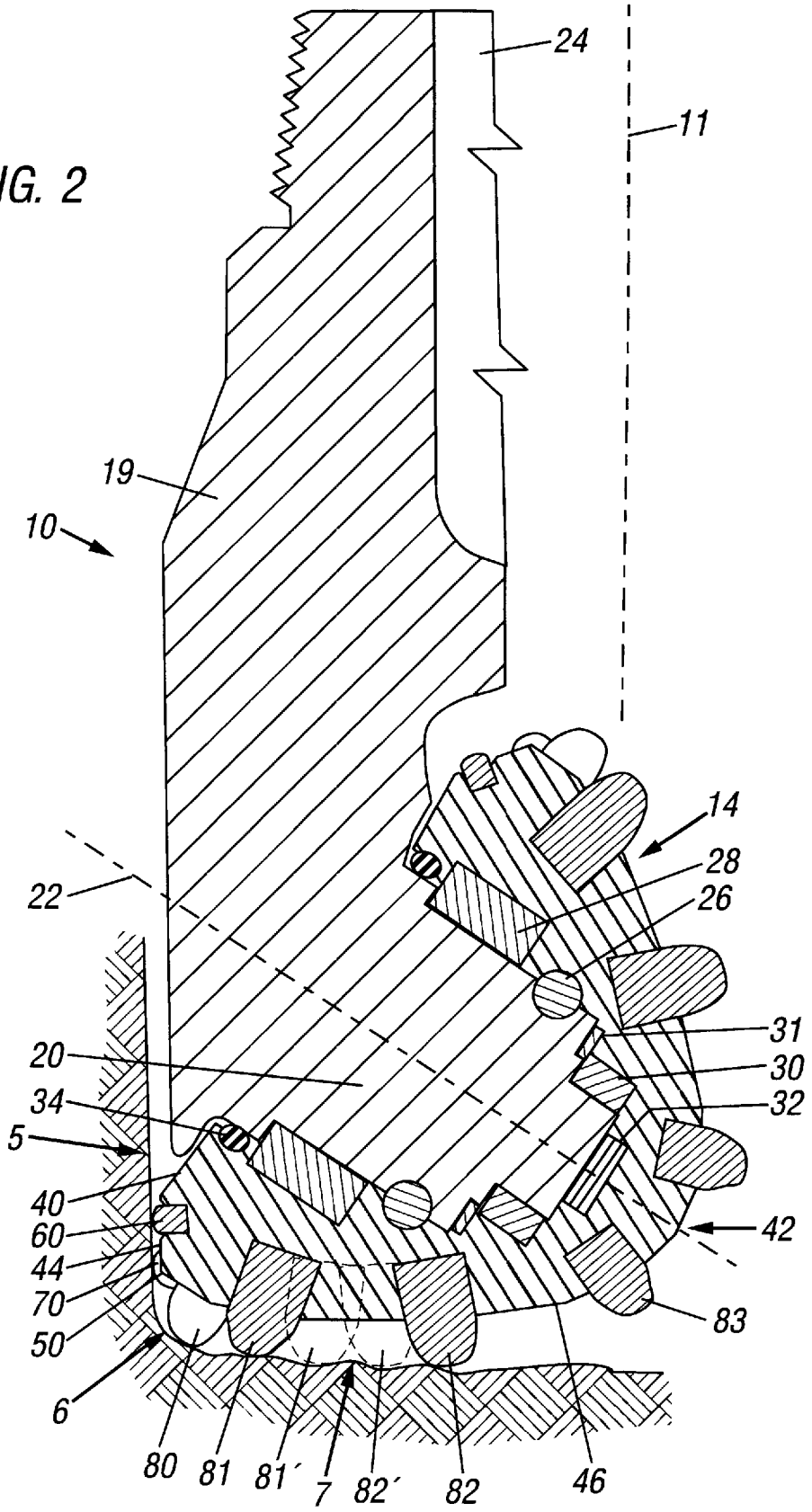
FIG. 2 is a partial section view taken through one leg and one rolling cone cutter of the bit shown in FIG. 1.

Referring now to FIG. 2, in conjunction with FIG. 1, each rolling cone cutter 14–16 is rotatably mounted on a pin or journal 20, with an axis of rotation 22 orientated generally downwardly and inwardly toward the center of the bit. Drilling fluid is pumped from the surface through fluid passage 24 where it is circulated through an internal passageway (not shown) to nozzles 18 (FIG. 1). Each cutter 14–16 is typically secured on pin 20 by ball bearings 26. In the embodiment shown, radial and axial thrust are absorbed by roller bearings 28, 30, thrust washer 31 and thrust plug 32; however, the invention is not limited to use in a roller bearing bit, but may equally be applied in a friction bearing bit. In such instances, the cones 14, 15, 16 would be mounted on pins 20 without roller bearings 28, 30. In both roller bearing and friction bearing bits, lubricant may be supplied from reservoir 17 to the bearings by apparatus that is omitted from the figures for clarity. The lubricant is sealed and drilling fluid excluded by means of an annular seal 34.

The borehole created by bit 10 includes sidewall 5, corner portion 6 and bottom 7, best shown in FIG. 2. Referring still to FIGS. 1 and 2, each rolling cone cutter 14–16 includes a backface 40 and nose portion 42 spaced apart from backface 40. Rolling cone cutters 14–16 each further include a frustoconical surface 44 that is adapted to retain cutter elements that scrape or ream the sidewall of the borehole as rolling cone cutters 14–16 rotate about the borehole bottom. Frustoconical surface 44 will be referred to herein as the "heel" surface of cutters 14–16, it being understood, however, that the same surface may be sometimes referred to by others in the art as the "gage" surface of a rolling cone cutter.

Extending between heel surface 44 and nose 42 is a generally conical surface 46 adapted for supporting cutter elements that gouge or crush the borehole bottom 7 as the cone cutters rotate about the borehole. Conical surface 46 typically includes a plurality of generally frustoconical segments 48 (FIG. 1) generally referred to as "lands" which are employed to support and secure the cutter elements as described in more detail below. Grooves 49 (FIG. 1) are formed in cone surface 46 between adjacent lands 48. Frustoconical heel surface 44 and conical surface 46 converge in a circumferential edge or shoulder 50. Although referred to herein as an "edge" or "shoulder," it should be understood that shoulder 50 may be contoured, such as a radius, to various degrees such that shoulder 50 will define a contoured zone of convergence between frustoconical heel surface 44 and the conical surface 46.

In the embodiment of the invention shown in FIGS. 1 and 2, each rolling cone cutter 14–16 includes a plurality of wear resistant inserts 60, 70, 80. Inserts 60, 70, 80 include generally cylindrical base portions that are secured by interference fit into mating sockets drilled into the lands of the rolling cone cutters, and cutting portions that are connected to the base portions and have cutting surfaces that extend from cone surfaces 44, 46 for cutting formation material. The present invention will be understood with reference to one such rolling cone cutter 14, cones 15, 16 being similarly, although not necessarily identically, configured.

As best shown in FIG. 1, rolling cone cutter 14 includes a plurality of heel row inserts 60 that are secured in a circumferential row 60*a*in the frustoconical heel surface 44. Cutter 14 preferably also includes a circumferential row 70*a* of nestled inserts 70 secured to cutter 14 in locations along or near the circumferential shoulder 50, a circumferential row 80*a* of gage inserts 80 secured to cutter 14 and a plurality of inner row inserts 81, 82, 83 secured to cone surface 46 and arranged in spaced-apart inner rows 81*a*, 82*a*, 83*a*, respectively. As understood by those skilled in this art, heel inserts 60 and nestled inserts 70 generally function to scrape or ream the borehole sidewall 5 to maintain the borehole at full gage and prevent erosion and abrasion of heel surface 44. Gage inserts 80 function primarily to cut the corner of the borehole, in that they cut both the sidewall and the bottom of the hole. Cutter elements 81, 82 and 83 of inner rows 81*a*, 82*a*, 83*a* are employed primarily to gouge and remove formation material from the borehole bottom 7. Inner rows 81*a*, 82*a*, 83*a* are arranged and spaced on rolling cone cutter 14 so as not to interfere with the inner rows on each of the other cone cutters 15, 16. While the present invention is described hereinafter in terms of a heel row insert 60 and nestled row inserts 70, it should be understood that the principle of the present invention can be advantageously applied to other cutter elements in rows whose primary function is reaming the borehole wall.

Figure 3:
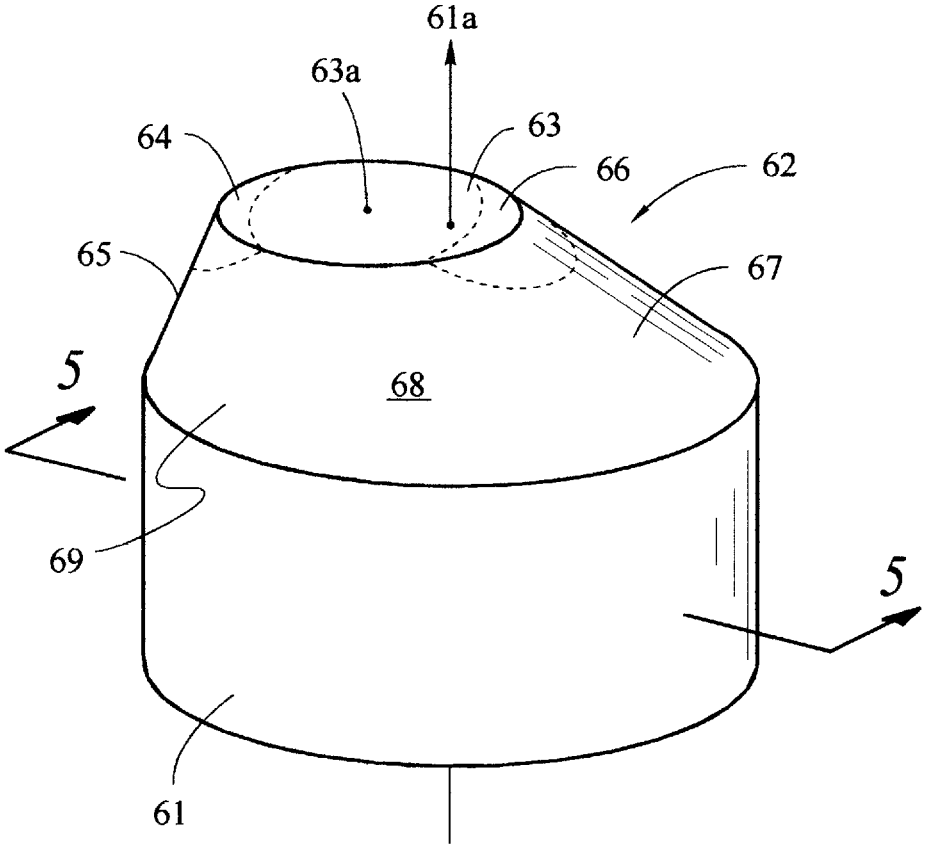
FIG. 3 is a perspective view of a single cutter element made in accordance with the principles of the present invention.
Figure 4:
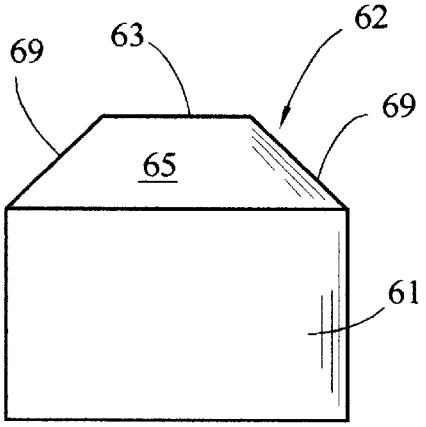
FIG. 4 is a front elevation of the cutter element shown in FIG. 3.
Figure 5:
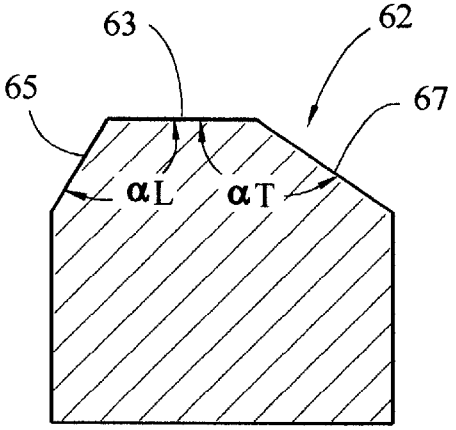
FIG. 5 is a section view taken along lines 5—5 of FIG. 3.

FIGS. 3–5 show a first preferred embodiment of the present invention, comprising a novel heel insert indicated generally by arrow 62. Insert 62 includes a cylindrical base 61 and a cutting surface 68. It should be noted that the base 61 is made in cylindrical form largely because it is the most practical. Other shapes of bases and corresponding sockets could be formed, but since it is more economical to drill circular holes in the cone for receiving base portion 61 of insert 62, cylindrical insert bases are generally preferred. Base 61 includes a longitudinal axis 61*a*.

Cutting surface 68 of insert 62 includes a wear face 63 that is adapted to extend beyond heel surface 44 of cone 14, a curved leading face 65, and a curved trailing face 67. Wear face 63 can be slightly convex, concave or flat. Wear face 63 includes a crescent-shaped leading transition section 64 and a crescent-shaped trailing transition section 66, both generally indicated in phantom in FIG. 3. Wear face 63 further includes a center point 63*a*, defined as the point midway between the leading transition section 64 and the trailing transition section 66 Leading transition section 64 and leading face 65 and are generally directly opposite trailing transition section 66 and trailing face 67 on insert 62. It will be understood that the terms leading transition section and trailing transition section do not refer to any particularly delineated section of the cutting face, but rather to those sections in which the stresses (compressive and tensile, respectively) are most highly concentrated. The position of leading and trailing transition sections 64, 66 relative to the axis of rolling cone 14 and to the base axis 61*a*, and the degree of their arcuate extension around insert 62 all depend on the design and geometry of rolling cone 14.

Figure 1B:
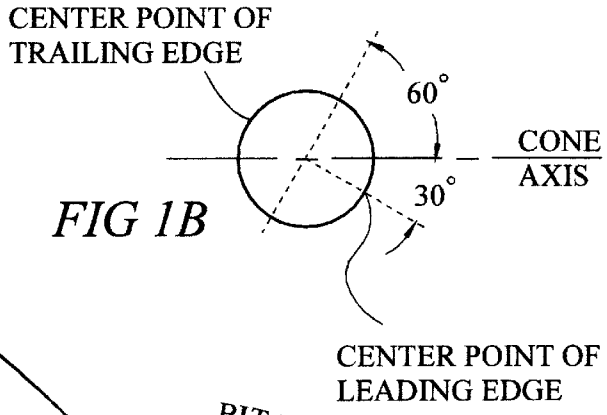
FIG. 1B is an enlarged view of a single cutter element from FIG. 1A, showing a preferred alternative orientation of the leading and trailing edges of the present cutter element.
Figure 1A:
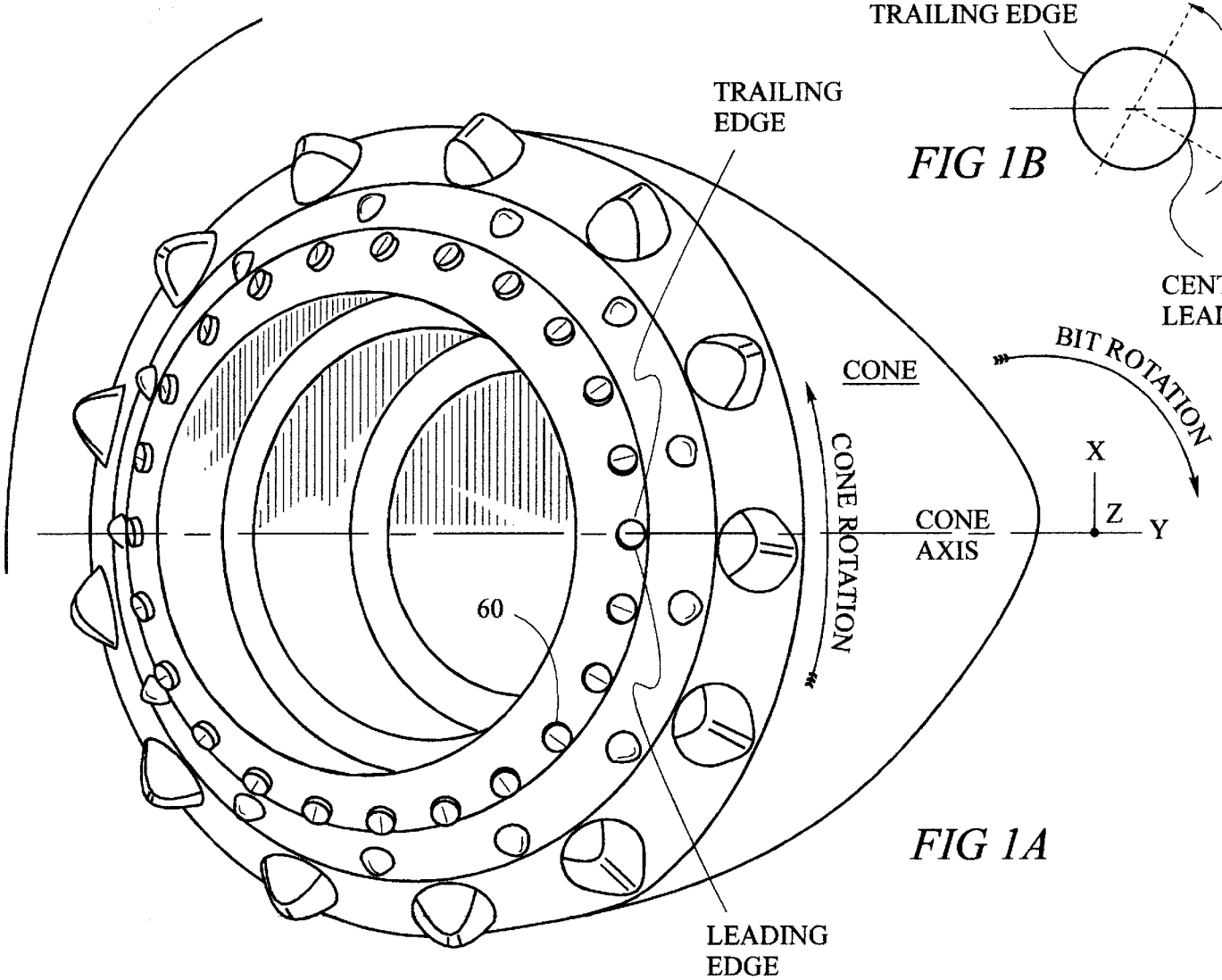
FIG. 1A is a plan view of a single rolling cone showing only gage, nestled and heel row cutter elements, taken along the bit axis from the pin end.

By way of illustration, reference is now briefly made to FIG. 1A, which illustrates the concepts of "leading" and "trailing" as they are used herein. FIG. 1A comprises a projection of the cutter element's position with respect to the axis of the rolling cone on which it is mounted. This is not the same as the cutter element's position with respect to the borehole wall as the cone rotates, which would include the lateral translation resulting from movement of the cone as it rotates. The portions of cutter element 60 that are designated leading and trailing in FIG. 1A correspond to the portions that have been determined to be subjected to compressive and tensile loading, respectively. As shown in FIG. 1A and described above, an imaginary line dividing the leading and trailing edges may be approximately parallel to the cone axis. In a typical preferred configuration, however, and for purposes of the following discussion, the center point of the leading edge lies approximately 10 to 45 degrees, and most preferably approximately 30 degrees, clockwise from the cone axis, as shown in FIG. 1B. Correspondingly, the imaginary line lies approximately 45 to 80 degrees, and most preferably approximately 60 degrees, counterclockwise of the cone axis.

Heel cutter 62, the present invention, differs significantly from conventional inserts, as best described with reference to FIGS. 3–5. Specifically, the leading transition 64 from wear face 63 to leading face 65 is much sharper than the trailing transition 66 from wear face 63 to trailing face 67. As used herein to describe a portion of a cutter element's cutting surface, the term "sharper" indicates that either (1) the angle defined by the intersection of two lines or planes or (2) the radius of curvature of a contoured interface, is smaller than a comparable measurement on another portion of cutting surface to which it is compared.

In the embodiment shown in FIGS. 3–5, the relative sharpness of the leading transition as compared to the trailing transition, is manifest in the relative magnitudes of inside angles $\alpha_L$ and $\alpha_T$, which measure the angles between wear face 63 and leading face 65 and between wear face 63 and trailing face 67, respectively. According to the embodiment shown in FIG. 5, angles $\alpha_L$ and $\alpha_T$ are 100° and 135°, respectively. It will be understood that angles $\alpha_L$ and $\alpha_T$ can be varied, so long as $\alpha_T$ is greater than $\alpha_L$.

Figure 6:
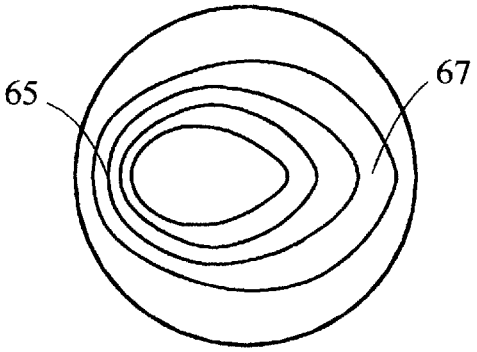
FIG. 6 is a plan view of a first alternative embodiment of the present cutter element including contour lines.
Figure 7:
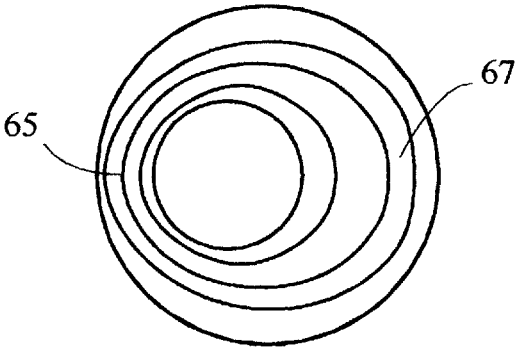
FIG. 7 is a plan view of the cutter element shown in FIG. 3 including contour lines.
Figure 8:
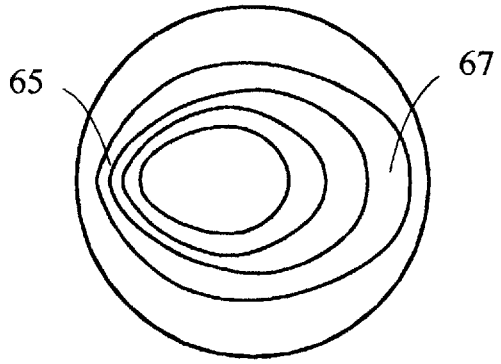
FIG. 8 is a plan view of a second alternative embodiment of the present cutter element including contour lines.
Figure 9:
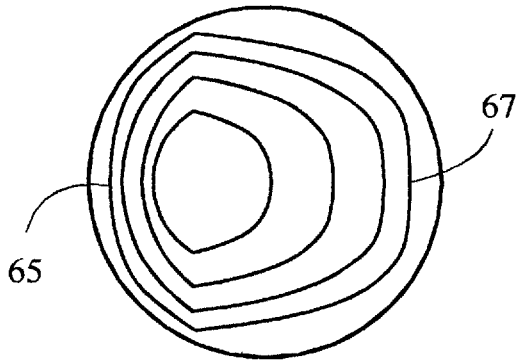
FIG. 9 is a plan view of a third alternative embodiment of the present cutter element including contour lines.

It is preferred that the sides 69 of insert 62 between leading face 65 and trailing face 67 be "contoured" or "sculpted," such that the cutting surface 68 of insert 62 is substantially free of any nontangential intersections. The term nontangential is intended to describe those interfaces that cannot be described as continuous curves. Non-circular wear faces are most clearly shown in FIGS. 6–8, wherein it can be seen that wear face 63 need not be circular and that the modification of the present invention can be applied to an insert regardless of the relative circumferences of the leading and trailing faces of the insert. In FIG. 6 curved leading face 65 has a greater radius of curvature than curved trailing face 67, in FIG. 7 the leading and trailing radii of curvature are equal and in FIG. 8 curved trailing face 67 has a greater radius of curvature than that of leading face 65. While the embodiments shown in FIGS. 6 and 8 have ovoid wear faces 63, other embodiments (not shown) incorporating the principles of the present invention could be made having wear faces 63 of other shapes. For example, FIG. 9 shows an embodiment in which the leading and trailing faces intersect nontangentially. It will be understood by those skilled in the art that each of the inserts shown in FIGS. 6–8 could be formed so as to have the cross-section shown in FIG. 5. Furthermore, the embodiments shown FIGS. 3–8 have leading and trailing faces that comprise sections of cones, with the cross-section of each face being defined by a straight line. In the alternative, leading and trailing faces can be curved in two directions, in the manner shown in FIGS. 10–11, described below.

The embodiments of the invention thus described are structured such that the center 63*a* of wear face 63 is shifted toward the leading face relative to the cutter element's axis. Also, cutter elements 62 are configured such that a trailing portion of the insert that is typically subject to the greatest tensile stresses is removed. For example, as illustrated in FIG. 3 the axis 61*a* of the cutter insert, as defined by the axis of its base, does not coincide with the center 63*a* of wear face 63. Instead, axis 61*a* a is well behind center 63*a*. This is in contrast to previously known inserts, in which the center of the wear face either coincides with the insert axis or is located behind the axis.

Figure 11:
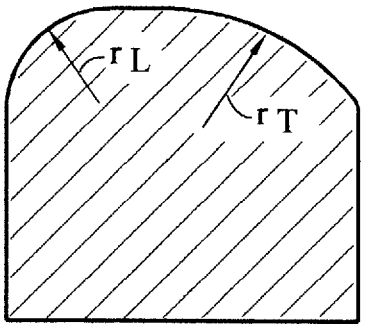
FIG. 11 is a section view taken along lines 10—10 of FIG. 10.
Figure 12:
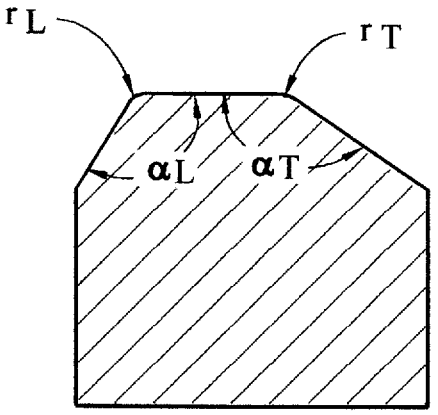
FIG. 12 is a section view of a fifth alternative embodiment of the present cutter element.
Figure 10:
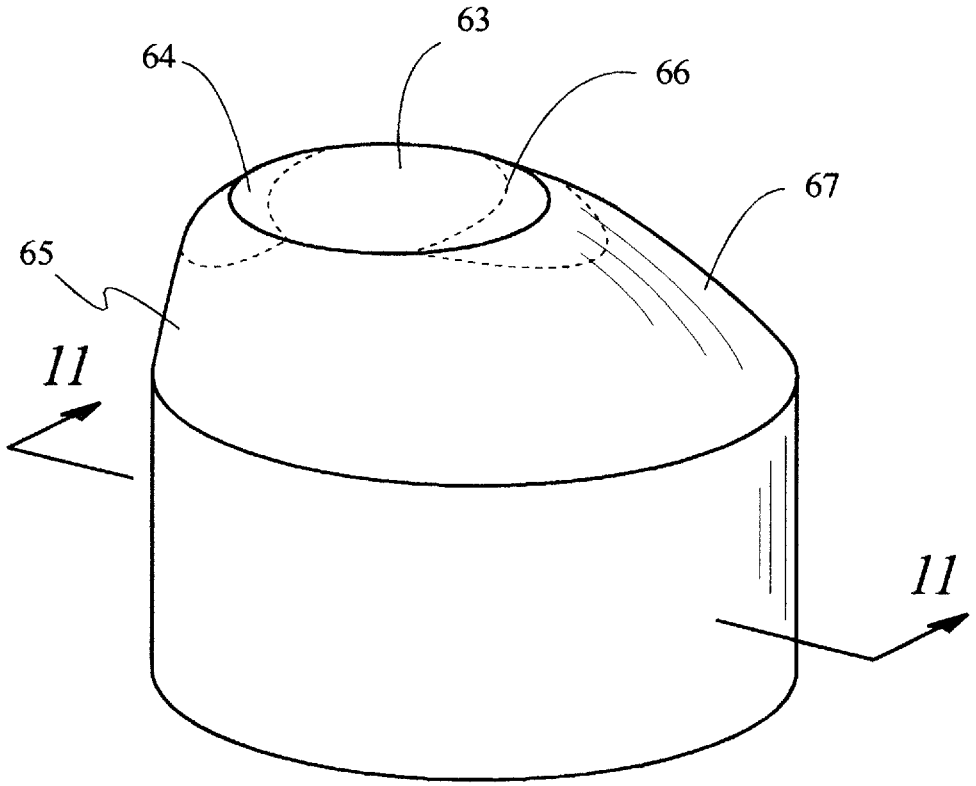
FIG. 10 is a perspective view of a fourth alternative embodiment of the present cutter element.

Referring now to FIGS. 10–11, a fourth preferred embodiment of the present insert uses rounded leading and trailing transitions and rounded leading and trailing faces. In FIGS. 10–12 and subsequent Figures, items common to the embodiment shown in FIGS. 3–5 are indicated by like reference numerals. Because the leading and trailing transitions are rounded, the relative sharpness of the leading and trailing transitions is manifest in the relative magnitudes of $r_L$ and $r_T$, (FIG. 11) which are the radii of curvature of the leading and trailing transitions, respectively. According to a preferred embodiment, radius $r_L$ and $r_T$ are 0.02 and 0.09 inches respectively. It will be understood that radii $r_L$ and $r_T$ can be varied, so long as $r_L$ is smaller than $r_T$. It will further be understood that embodiments exist, such as that shown in FIG. 12, in which the transitions are rounded and trailing radius $r_L$ is greater than $r_T$, but the desired relative sharpnesses of the leading and trailing transitions is maintained because of the relative magnitudes of angles $\alpha_L$ and $\alpha_T$. It will be further understood that the present invention does not require that both transitions be rounded, or both angled, so long as the leading transition is sharper than the trailing transition. For example, one or both transitions can include a chamfer, which can affect the sharpness of the transition by its depth. Likewise, if the curvature of the transition is not constant, but is elliptical or otherwise curved, the radius of the transition may not be a pure radius. It will be understood that in such instances, the smallest radius of curvature for each transition may be used for comparative purposes, or the position of the center of the wear face with respect to the axis of the base may be considered, if that measurement is more direct.

Figure 13:
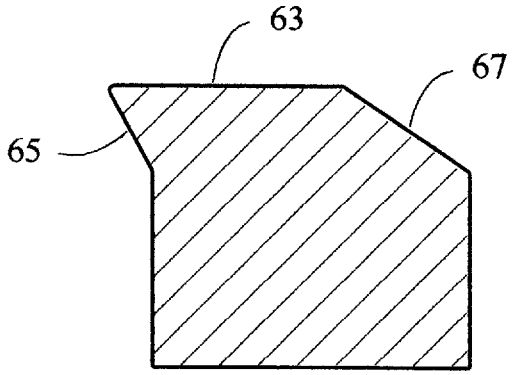
FIG. 13 is a section view of a sixth alternative embodiment of the present cutter element.
Figure 14:
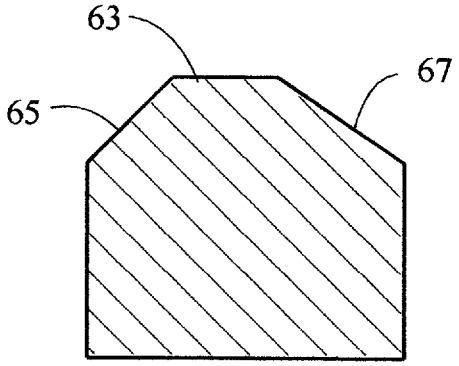
FIG. 14 is a section view of a seventh alternative embodiment of the present cutter element.
Figure 15:
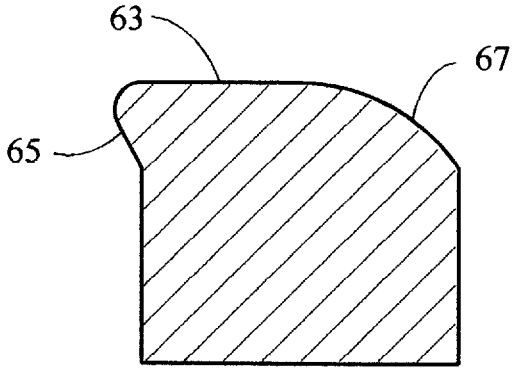
FIG. 15 is a section view of an eighth alternative embodiment of the present cutter element.

FIGS. 13–15 illustrate that the advantages of the present invention can be maintained even where the insert is formed to have significant amounts of positive or negative rake angle in the leading edge. Specifically, FIG. 13 shows a cutter element having a positive rake angle on its leading face 65. The embodiment shown in FIG. 14 has a more negative rake angle than that shown in FIG. 5, but still conforms to the principles of the present invention. FIG. 15 shows a cutter element having an extremely aggressively shaped leading face 65, similar to the leading edge of FIG. 13, but having a radiused intersection with 63 to reduce stress and to diminish the possibility of breakage. Increasing the positive rake angle of the leading face reduces the forces and torque from the cutting action, which in turn increases ROP potential of the bit.

Figure 19C:
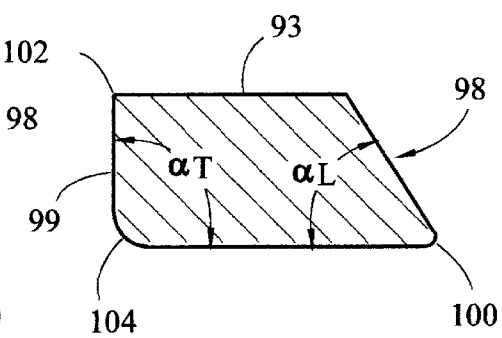
FIG. 19A,B,C are cross-sectional views taken along lines 19—19 of FIG. 17, showing alternative embodiments of the cross section of the cutter element shown in FIG. 17.
Figure 19B:
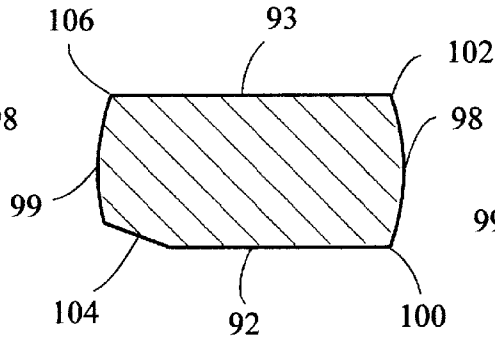
Figure 19A:
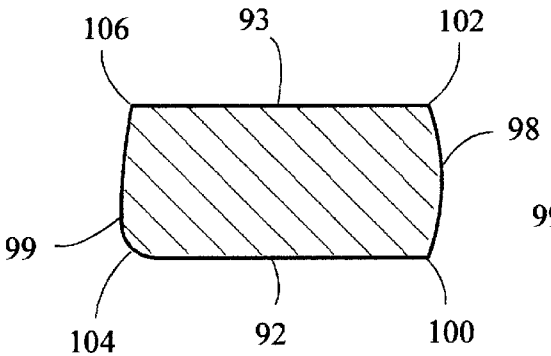

Referring now to FIGS. 17, 18 and 19A–C, an alternative construction of the present cutter element has an essentially chisel-shaped configuration. The chisel-shaped insert 90 has an outer wear face 92 generally oriented toward the borehole wall, an inner face 93 substantially opposite the outer wear face, a crest 94 and leading and trailing faces 98, 99, respectively. According to the present invention, chisel-shaped insert 90 is oriented in the rolling cone so that its crest is perpendicular to the axis of the cone. Thus, insert 90 further includes a leading transition 95 between leading face 98 and crest 94 and a trailing transition 96 between trailing face 99 and crest 94. In addition, the intersections of the outer wear face 92 and inner face 93 with the leading and trailing faces 98, 99 define four transitions, identified as outer leading transition 100, inner leading transition 102, outer trailing transition 104 and inner trailing transition 106. As described above, the leading transition 95 is sharper than trailing transition 96. The insert of this embodiment can be made symmetrical, so that each pair of leading and trailing transitions 100/102 and 104/106 is substantially the same. As described with respect to the previous embodiments, this chisel-shaped insert can be modified in a similar manner such that the outer trailing transition is adapted so as to further reduced the tensile forces applied to the insert, as shown in FIGS. 19A–C. FIG. 19A shows an embodiment in which outer trailing transition 104 is contoured with a larger radius of curvature than that of outer leading transition 100 and FIG. 19B shows an embodiment in which the same intersection 104 is made essentially planar by eliminating a portion of the insert at the corner. FIG. 19C shows an embodiment in which the leading face 98 has a positive rake angle, illustrated at transition 100.

By changing the geometry of the trailing portion of a heel cutter insert 60 and nestled insert 70, the portion of the insert placed in greatest tensile stress during operation is eliminated. In this manner, the tensile stresses that would otherwise be applied to the insert can be relieved without adversely affecting the amount of mechanical support provided to leading section 64 by the body of cutter 62. It is this relationship that results in the improvement in cutter life and the desired features of the present invention.

The failure mode of cutter elements usually manifests itself as either breakage, wear, or mechanical or thermal fatigue. Wear and thermal fatigue are typically results of abrasion as the elements act against the formation material. Breakage, including chipping of the cutter element, typically results from impact loads, although thermal and mechanical fatigue of the cutter element can also initiate breakage. The trailing edge of prior art inserts is subjected to a combination of abrasive wear, frictional heat, tensile and impact forces from the cutting action. On tungsten carbide inserts, the frictional heat combined with rapid cooling by the drilling fluid can lead to thermal fatigue, initiating a network of micro cracks on the surface. Tensile forces on the unsupported trailing edge put the trailing portion of the insert under tensile stress, causing the cracks to propagate by mechanical fatigue leading to chipping or breakage. Prior art inserts coated with polycrystalline diamond (PCD) are prone to chipping and breakage of the trailing portion due to tensile and impact forces from the cutting action.

The present invention addresses the above failure modes by significantly reducing the tensile loading on the trailing portion of the insert. In addition, the new geometry of the trailing section provides structural support to better enable the insert to withstand tensile and impact forces that result from the cutting action. Due to a lesser area being presented to the formation, the frictional heat is more efficiently dissipated and therefore the potential of thermal fatigue is reduced. Even if thermal fatigue should occur, the new geometry of the present insert is better suited to withstand the mechanical loading that causes chipping and breakage. The new and improved geometry of the trailing portion provides increased opportunities for inserts with superabrasive coatings, such as PCD and PCBN, since the principal factors that cause the superabrasive coating to fail are greatly reduced.

The present cutter element is a departure from prior art multi-cone bit cutter elements that have generally either required that the leading and trailing transitions of the cutter element be symmetrical, or have provided trailing transitions that are sharper than their leading transitions. In other systems, attempts have been made to reduce the tensile stresses and premature failure in the heel row inserts by inclining the whole cutter element so that its trailing portion is at a greater distance from the borehole wall than is its leading portion. These devices, however, have the adverse affect of forcing the leading edge of wear face 63 to do all of the work associated with scraping and/or reaming the borehole sidewall. In the present invention, the positioning of wear face 63 with respect to the borehole wall is maintained so that virtually the entire wear face 63 can operate on the borehole sidewall.

A particularly preferred embodiment of the present invention includes use of cutter inserts in accordance with the present invention in a bit having gage and off-gage cutter elements positioned to separate sidewall and bottom hole cutting duty. A bit of this sort is fully disclosed and described in commonly owned copending application filed on Apr. 10, 1996, Ser. No.: 08/630,517, and entitled Rolling Cone Bit with Gage and Off-gage Cutter Elements Positioned to Separate Sidewall and Bottom Hole Cutting Duty, which is hereby incorporated by reference as if fully set forth herein. The cutter inserts of the present invention, having a relatively sharper leading section and relatively less sharp trailing section, can be used advantageously in place of any one or more of heel row inserts or gage row inserts, as described in the copending application. In addition, it will be understood that the cutter inserts of the present invention can be used in bits that have more than one heel row.

Figure 16:
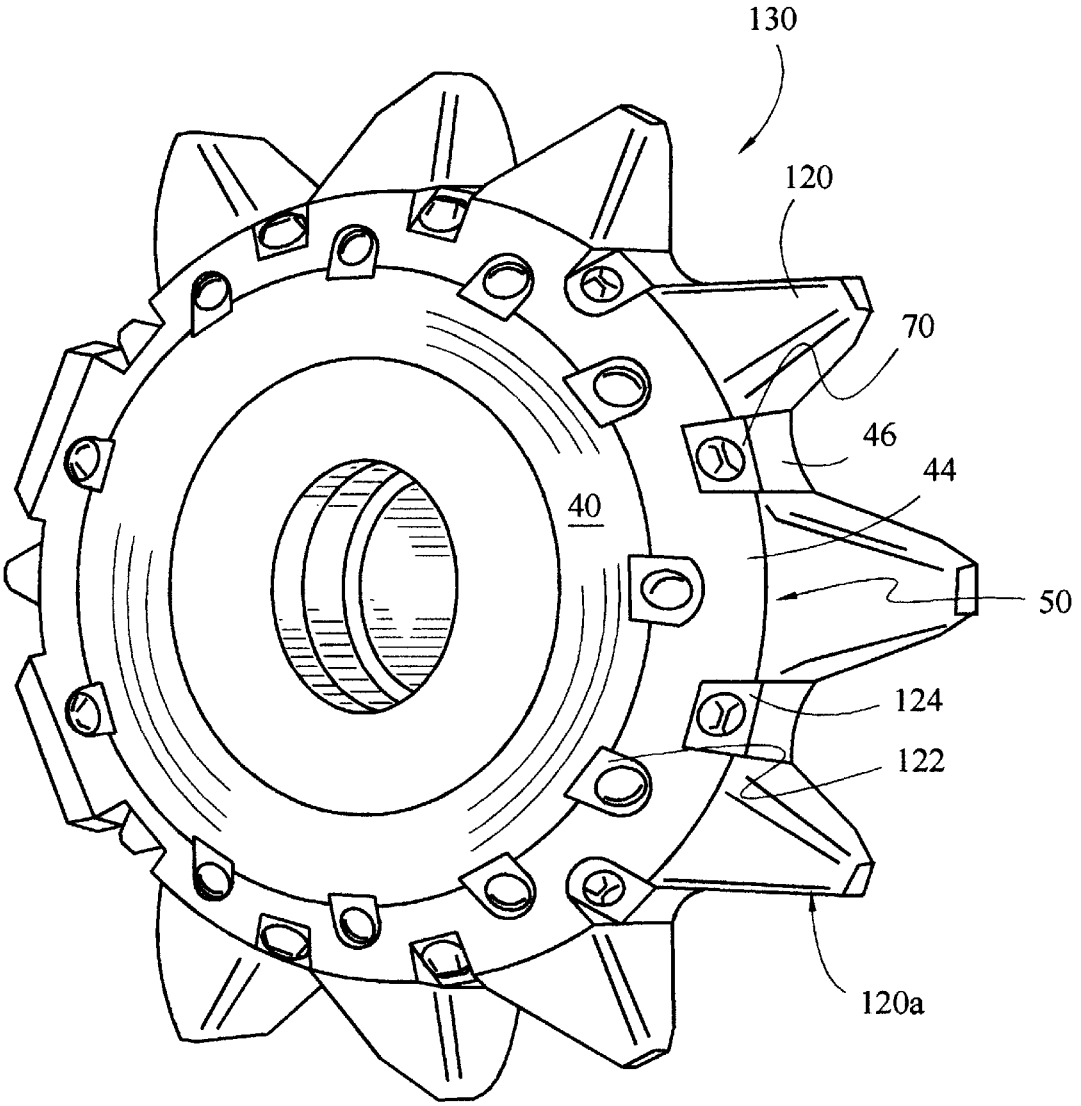
FIG. 16 is a perspective view of a steel tooth cutter incorporating the cutter element of the present invention.
Figure 18:
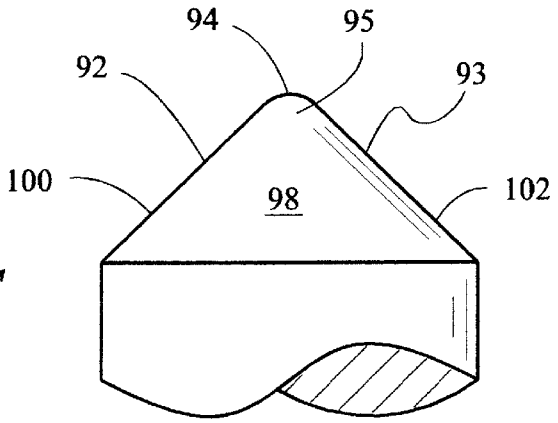
FIG. 18 is a front elevation of the embodiment shown in FIG. 17.
Figure 17:
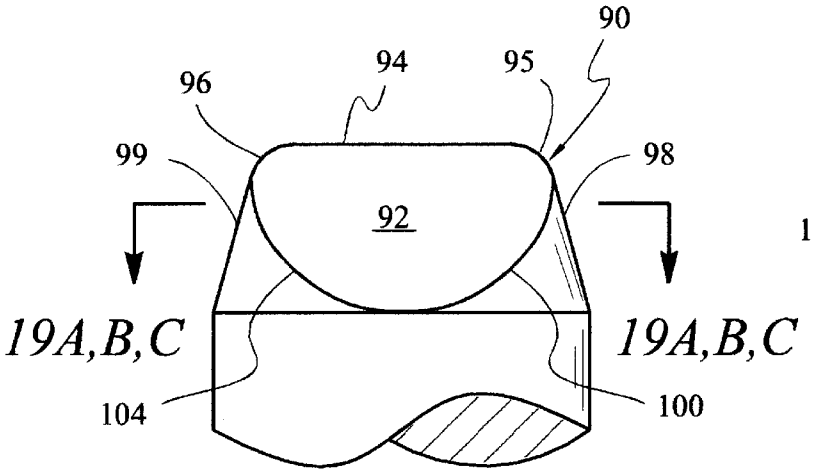
FIG. 17 is a side elevation of a ninth alternative embodiment of the present cutter element.

Furthermore, the present invention may be employed in steel tooth bits as well as TCI bits as will be understood with reference to FIG. 16. As shown, a steel tooth cone 130 is adapted for attachment to a bit body 12 in a like manner as previously described with reference to cones 14–16. When the invention is employed in a steel tooth bit, the bit includes a plurality of cutters such as rolling cone cutter 130. Cutter 130 includes a backface 40, a generally conical surface 46 and a heel surface 44 which is formed between conical surface 46 and backface 40, all as previously described with reference to the TCI bit shown in FIGS. 1–2. Similarly, steel tooth cutter 130 includes heel row inserts 60 embedded within heel surface 44, and nestled row cutter elements such as inserts 70 disposed adjacent to the circumferential shoulder 50 as previously defined. Although depicted as inserts, nestled cutter elements 70 may likewise be steel teeth or some other type of cutter element. Relief 122 is formed in heel surface 44 about each insert 60. Similarly, relief 124 is formed about nestled cutter elements 70, relieved areas 122, 124 being provided as lands for proper mounting and orientation of inserts 60, 70. In addition to cutter elements

60, 70, steel tooth cutter 130 includes a plurality of gage row cutter elements 120 generally formed as radially-extending teeth. Steel teeth 120 include an outer layer or layers of wear resistant material 120*a* to improve durability of cutter elements 120.

Steel tooth cutters such as cutter 130 have particular application in relatively soft formation materials and are preferred over TCI bits in many applications. Nevertheless, even in relatively soft formations, in prior art bits in which the gage row cutters consisted of steel teeth, the substantial sidewall cutting that must be performed by such steel teeth may cause the teeth to wear to such a degree that the bit becomes undersized and cannot maintain gage. The benefits and advantages of the present invention that were previously described with reference to a TCI bit apply equally to steel tooth bits. Namely, any of heel row cutters 60 and nestled row cutters 70 can be configured in accordance with the principles set out herein if it is desired to reduce the effects of tensile stress on the cutter elements.

While various preferred embodiments of the invention have been shown and described, modifications thereof can be made by one skilled in the art without departing from the spirit and teachings of the invention. The embodiments described herein are exemplary only, and are not limiting. Many variations and modifications of the invention and apparatus disclosed herein are possible and are within the scope of the invention. Accordingly, the scope of protection is not limited by the description set out above, but is only limited by the claims which follow, that scope including all equivalents of the subject matter of the claims.

What is claimed is:

1. A shaped cutter element for use in a rolling cone drill bit, comprising:

a cutting surface, said cutting surface including a leading face, a trailing face, and a wear face having leading and trailing sections, said leading face and said leading section defining a leading transition therebetween and said trailing face and said trailing section defining a trailing transition therebetween;

wherein said leading transition is sharper than said trailing transition.

2. The cutter element according to claim 1, wherein substantially all of said wear face engages the borehole wall.

3. The cutter element according to claim 2, wherein at least one of said leading and trailing faces is curved.

4. The cutter element according to claim 2, wherein said wear face is substantially flat.

5. The cutter element according to claim 2, wherein the perimeter of said wear face is substantially round.

6. The cutter element according to claim 2, wherein the perimeter of said wear face is substantially ovoid.

7. The cutter element according to claim 2, wherein said cutter element is used in a heel row of a rolling cone cutter.

8. The cutter element according to claim 7, wherein a portion of said heel row includes contoured cutter elements.

9. The cutter element according to claim 1, wherein each of said transitions comprises the intersection of a flat plane and a section of a cone and the inside angle between said plane and said cone section at said leading transition is smaller than the inside angle between said plane and said cone section at said trailing transition.

10. The cutter element according to claim 1, wherein each of said transitions comprises a contoured corner having a radius of curvature and the largest radius of curvature of said leading transition is smaller than the smallest radius of curvature of said trailing transition.

11. The cutter element according to claim 10, wherein said cutter element is used in a heel row of a rolling cone cutter.

12. The cutter element according to claim 2, wherein said cutter element is used in a nestled row of a rolling cone cutter, said nestled row being positioned adjacent a circumferential shoulder of a rolling cone cutter.

13. The cutter element according to claim 12, wherein said cutter element is used in a plurality of the cutter element positions in said nestled row.

14. The cutter element according to claim 12, wherein at least a portion of the cutter elements in said nestled row have cutting surfaces that are free of non-tangential intersections.

15. The cutter element according to claim 2, wherein said leading face has a positive rake angle.

16. The cutter element according to claim 2, wherein said leading face has a negative rake angle.

17. The cutter element according to claim 1, wherein at least a portion of said cutter element is coated with a wear resistant superabrasive layer.

18. The cutter element according to claim 17 wherein said wear resistant superabrasive layer comprises polycrystalline diamond.

19. The cutter element according to claim 17, wherein said wear resistant superabrasive layer comprises cubic boron nitride.

20. A shaped cutter element for use in a rolling cone on a rolling cone drill bit, comprising:

a cutting surface, said cutting surface including a leading face, a trailing face, and a wear face having leading and trailing sections, said leading face and said leading section defining a leading transition therebetween and said trailing face and said trailing section defining a trailing transition therebetween;

wherein said leading transition is sharper than said trailing transition; and wherein said cutter element further includes a base portion, said base portion being adapted to extend into a matching socket in the rolling cone.

21. The cutter element according to claim 20, wherein substantially all of said wear face engages the borehole wall.

22. The cutter element according to claim 20, wherein at least one of said leading and trailing faces is curved.

23. The cutter element according to claim 20, wherein said wear face is substantially flat.

24. The cutter element according to claim 20, wherein the perimeter of said wear face is substantially round.

25. The cutter element according to claim 20, wherein the perimeter of said wear face is substantially ovoid.

26. The cutter element according to claim 20, wherein said cutter element is used in a heel row of a rolling cone cutter.

27. The cutter element according to claim 26, wherein a portion said heel row includes contoured cutter elements.

28. The cutter element according to claim 20, wherein each of said transitions comprises the intersection of a flat plane and a section of a cone and the inside angle between said plane and said cone section at said leading transition is smaller than the inside angle between said plane and said cone section at said trailing transition.

29. The cutter element according to claim 20, wherein each of said transitions comprises a contoured corner having a radius of curvature and the largest radius of curvature of said leading transition is smaller than the smallest radius of curvature of said trailing transition.

30. The cutter element according to claim 29, wherein said cutter element is used in a heel row of a rolling cone cutter.

31. The cutter element according to claim 20 wherein said cutter element is used in a nestled row of a rolling cone cutter, said nestled row being positioned adjacent a circumferential shoulder of a rolling cone cutter.

32. The cutter element according to claim 31 wherein said cutter element is used in a plurality of the cutter element positions in said nestled row.

33. The cutter element according to claim 31 wherein at least a portion of the cutter elements in said nestled row have cutting surfaces that are free of nontangential intersections.

34. The cutter element according to claim 20 wherein said leading face has a positive rake angle.

35. The cutter element according to claim 20 wherein said leading face has a negative rake angle.

36. The cutter element according to claim 20 wherein at least a portion of said cutter element is coated with a wear resistant superabrasive layer.

37. The cutter element according to claim 36, wherein said wear resistant superabrasive layer comprises polycrystalline diamond.

38. The cutter element according to claim 36, wherein said wear resistant superabrasive layer comprises cubic boron nitride.

39. A shaped cutter element for use in a rolling cone drill bit for cutting a borehole, comprising:

a base portion, said base portion having a longitudinal axis; and a wear face, said wear face including leading and trailing sections and a center point therebetween;

wherein longitudinal axis passes through said wear face at a point between said center point and said trailing section and said wear face engages the borehole wall and said wear face functions primarily to ream the borehole wall.

40. The cutter element according to claim 39 wherein said wear face is substantially flat.

41. The cutter element according to claim 39, further including curved leading and trailing faces that intersect said wear face.

42. The cutter element according to claim 39 wherein said base portion is adapted to extend into a matching socket in the bit cone.

43. An earth boring bit for drilling a borehole, the bit comprising:

a bit body having a bit axis;

at least one rolling cone cutter rotatably mounted on said bit body and having a generally conical surface and an adjacent heel surface;

a plurality of heel cutter elements positioned on said heel surface; and a plurality of nestled cutter elements positioned adjacent a circumferential shoulder of said cone;

at least one of said cutter elements comprising a base and a cutting surface having leading and trailing sections wherein said leading section is sharper than said trailing section.

44. The bit according to claim 43 wherein at least one of said heel cutter elements and at least one of said nestled cutter elements each comprise a base and a cutting surface having leading and trailing sections wherein said leading section is sharper than said trailing section.

45. The bit according to claim 43 wherein all of said heel cutter elements comprise a base and a cutting surface having leading and trailing sections wherein said leading section is sharper than said trailing section.

46. The bit according to claim 43 wherein said cutter elements have cutting surfaces that are free of nontangential interfaces.

47. The bit according to claim 43 wherein said cutter elements are coated with a superabrasive layer.

48. The bit according to claim 47 wherein said superabrasive layer comprises polycrystalline diamond.

49. The bit according to claim 47 wherein said superabrasive layer comprises cubic boron nitride.

50. The bit according to claim 43 wherein said bases each include a longitudinal axis and said cutting surfaces each include a center point between said leading and trailing sections, and wherein said center point lies in front of said axis.

51. A chisel shaped cutter element for use in a rolling cone bit for cutting a borehole, said cutter element having an outer wear face, an inner face, a crest and leading and trailing faces, said crest being oriented at an angle with respect to the axis of the rolling cone, said crest and said leading face defining a leading transition and said crest and said trailing face defining a trailing transition, said leading transition being sharper than said trailing transition.

52. The chisel shaped cutter element according to claim 51 wherein said angle between said crest and said cone axis is between about 0 and about 90 degrees.

53. The chisel shaped cutter element according to claim 52 wherein said angle is approximately 90 degrees.

54. The chisel shaped cutter element according to claim 53 wherein said wear face primarily reams the borehole wall.

55. The chisel shaped cutter element according to claim 54 wherein said angle between said crest and said cone axis is between about 0 and about 90 degrees.

56. The chisel shaped cutter element according to claim 55 wherein the transition between said outer wear face and said leading face is sharper than the transition between said outer wear face and said trailing face.

57. The chisel shaped cutter element according to claim 55 wherein said inner face and outer wear face and said leading and trailing faces define four transitions: an outer leading transition, an inner leading transition, an outer trailing transition, and an inner trailing transition; and said outer trailing transition is contoured with a greater radius of curvature than that of the inner trailing transition.

58. The chisel shaped cutter element according to claim 55 wherein said inner face and outer wear face and said leading and trailing faces define four transitions: an outer leading transition, an inner leading transition, an outer trailing transition, and an inner trailing transition; and said outer trailing transition is made essentially planar.

59. The chisel shaped cutter element according to claim 55 wherein a portion of said cutter element is coated with a superabrasive layer.

60. The chisel shaped cutter element according to claim 59 wherein said superabrasive layer comprises PCD.

61. The chisel shaped cutter element according to claim 59 wherein said superabrasive layer comprises PCBN.

62. A chisel shaped cutter element for use in a roller cone bit, said cutter element having an outer wear face, an inner face, a crest and leading and trailing faces, said crest being oriented at an angle with respect to the axis of the rolling cone, said outer wear face and said leading face defining an outer leading transition and said outer wear face and said trailing face defining an outer trailing transition, said outer leading transition being sharper than said outer trailing transition.

63. The chisel shaped cutter element according to claim 62 wherein said wear face primarily reams the borehole wall and said angle between said crest and said cone axis is between about 0 and about 90 degrees.

64. The chisel shaped cutter element according to claim 63 wherein said crest and said leading face defining a leading crest transition and said crest and said trailing face defining a trailing crest transition, said leading crest transition being sharper than said trailing crest transition.

65. The chisel shaped cutter element according to claim 63 wherein said inner face and said leading and trailing faces define two transitions: an inner leading transition and an inner trailing transition; and said outer trailing transition is contoured with a greater radius of curvature than that of the inner trailing transition.

66. The chisel shaped cutter element according to claim 63 wherein said outer trailing transition is made essentially planar.

67. The chisel shaped cutter element according to claim 63 wherein a portion of said cutter element is coated with a superabrasive layer.

68. The chisel shaped cutter element according to claim 67 wherein said superabrasive layer comprises PCD.

69. The chisel shaped cutter element according to claim 67 wherein said superabrasive layer comprises PCBN.

* * * * *